US006139446A

United States Patent [19]

Wanchena

[11] Patent Number: 6,139,446

[45] Date of Patent: Oct. 31, 2000

[54] GOLF CLUB

[75] Inventor: Michael A. Wanchena, Delano, Minn.

[73] Assignee: Wedgewood Golf, Inc., Delano, Minn.

[21] Appl. No.: 09/127,855

[22] Filed: Aug. 3, 1998

[51] Int. Cl.[7] ..... A63B 53/04

[52] U.S. Cl. ..... 473/349; 473/344; 473/328

[58] Field of Search ..... 473/324, 328, 473/343, 344, 345, 349, 350, 292, 290, 291

[56] References Cited

U.S. PATENT DOCUMENTS

| | | | |
|---|---|---|---|
| D. 239,187 | 3/1976 | Smith . | |
| D. 262,049 | 11/1981 | Simmons . | |
| D. 302,716 | 8/1989 | Giambazi . | |
| D. 313,828 | 1/1991 | Wilson . | |
| D. 345,402 | 3/1994 | Wilson . | |
| D. 358,186 | 5/1995 | Mollison et al. . | |
| D. 363,100 | 10/1995 | Long et al. . | |
| 1,690,388 | 11/1928 | Waldron . | |
| 3,138,386 | 6/1964 | Onions . | |
| 3,810,631 | 5/1974 | Braly . | |
| 3,862,759 | 1/1975 | Evans et al. . | |
| 3,976,299 | 8/1976 | Lawrence et al. . | |
| 3,997,171 | 12/1976 | Currie . | |
| 4,162,794 | 7/1979 | Thompson | 473/344 |
| 4,313,607 | 2/1982 | Thompson | 473/344 |
| 4,322,083 | 3/1982 | Imai . | |
| 4,431,192 | 2/1984 | Stuff, Jr. . | |
| 4,762,322 | 8/1988 | Molitor et al. | 473/292 |
| 4,836,550 | 6/1989 | Kobayashi . | |
| 4,850,593 | 7/1989 | Nelson . | |
| 4,900,029 | 2/1990 | Sinclair . | |
| 5,429,354 | 7/1995 | Long et al. . | |
| 5,518,242 | 5/1996 | Mahaffey et al. . | |
| 5,746,666 | 5/1998 | Lovett | 473/328 |

*Primary Examiner*—Kien T. Nguyen
*Attorney, Agent, or Firm*—Merchant & Gould P.C.

[57] ABSTRACT

A golf club is provided, comprising a striking surface, a toe region, a heel region, a sole plate, a mass region and a hosel, the golf club further comprising a shaft attached to the club head by hosel of the club head. The sole plate extends from a bottom edge of the striking surface to a rear edge of the mass region and under the toe region to the heel region. The sole plate comprises the sole which contacts the ground as the club head lies at rest and has a width between about ½ inch and about 1½ inches. The mass region extends from the top side of the striking surface to the rear edge of the sole plate. The club head includes a vertical center of gravity below a median between the top edge of the striking surface and the bottom edge of the striking surface.

18 Claims, 5 Drawing Sheets

GOLF CLUB

FIELD OF THE INVENTION

The present invention relates to a golf club, and more particularly to a golf club which combines advantageous features wedge clubs and woods.

BACKGROUND OF THE INVENTION

Golf clubs are generally categorized as either woods or irons. Woods, including metal woods, are typically used to hit a golf ball long distances. Irons are typically used to hit a golf ball both long and short distances, and for purposes for which metal woods are not typically used, including hitting out of deep rough, fairway bunkers and chipping around the green. A subcategory of woods has become popular in recent years. These woods, known as "utility metal woods," are typically used in place of mid range and short range irons to hit a golf ball shorter distances.

SUMMARY OF THE INVENTION

A golf head comprising a striking surface, a toe region, a heel region, a sole plate, a mass region and a hosel, the golf club further comprising a shaft attached to the club head by hosel of the club head. The sole plate extends from a bottom edge of the striking surface to a rear edge of the mass region and under the toe region to the heel region. The sole plate comprises the sole which contacts the ground as the club head lies at rest and preferably has a width of between about ½ inch and about 1½ inches. The mass region extends from the top side of the striking surface to the rear edge of the sole plate. The club head includes a vertical center of gravity which is preferably below a median between the top edge of the striking surface and the bottom edge of the striking surface.

The golf club of the invention provides a low vertical center of gravity. It is believed that this feature makes it generally easier to hit accurately than other golf clubs. The golf club of the present invention is also especially useful in certain situations, including, for example, hitting a golf ball out of a difficult lie (such as from the rough or from a fairway bunker), hitting a golf ball over tall obstacles and hitting a golf ball with a high trajectory so as to have it land with minimal roll. It is also useful for less accomplished golfers generally, by allowing them get the golf ball airborne more easily than with other clubs.

The above summary of the present invention is not intended to describe each illustrated embodiment or every implementation or the present invention. The figures and detailed description which follow particularly exemplify these embodiments.

DETAILED DESCRIPTION OF THE PREFERRED EMBODIMENT

Figure 1:
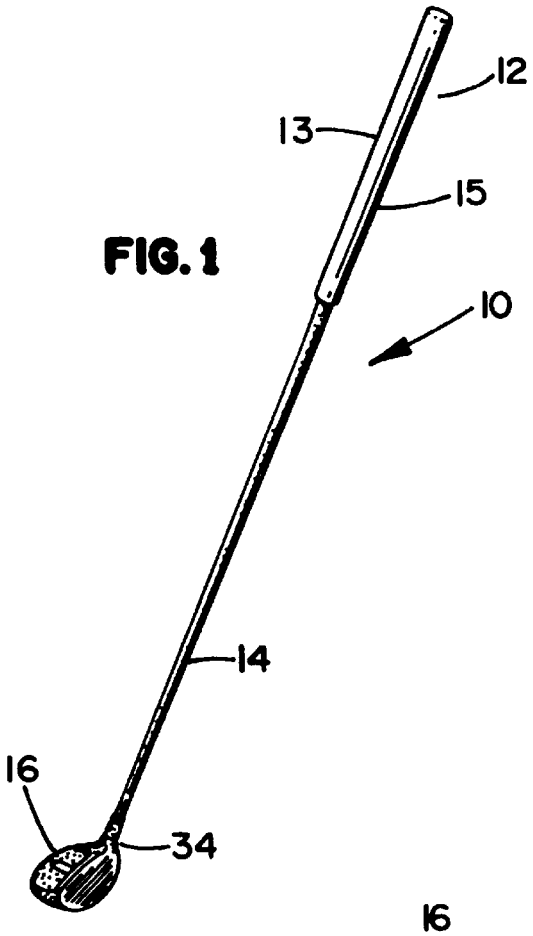
FIG. 1 is a perspective view of a preferred golf club according to the principles of the present invention.

The preferred embodiments of the invention are now described in detail and with reference to the drawings, wherein like reference numerals represent like parts throughout the several views. Reference to the preferred embodiments does not limit the scope of the invention, which is limited only by the scope of the claims attached hereto.

Referring to FIGS. 1–9, a golf club in accordance with the present invention is depicted at reference number 10. The golf club 10 includes a handle 12, a shaft 14 and a club head 16.

The handle 12 is used by a golfer to hold or to grip the club and circumscribes the end of the shaft 14 opposite from the club head 16. The handle 12 includes a gripping surface 13, where the golfer places his or her hands when holding the club, which is generally located in the mid-section 15 of the handle 12.

The shaft 14 extends through the handle 12 to the hosel 34 of the club head 16. The shaft may vary in length. Conventional shaft lengths which can be used with the invention include 36, 37, 38, 39, 40, 41 and 42 inches. The shaft may vary in flexibility. It is desirable to employ a shaft in a particular golf club to match the swing speed of the golfer, so that the degree of flexibility of the club allows the club head to flex and spring towards the golf ball at the appropriate time during the swing sequence. More flexible shafts should be employed in golf clubs for golfers with slower swing speeds, whereas stiffer shafts should be used in clubs for golfers with faster swing speeds.

Figure 2:
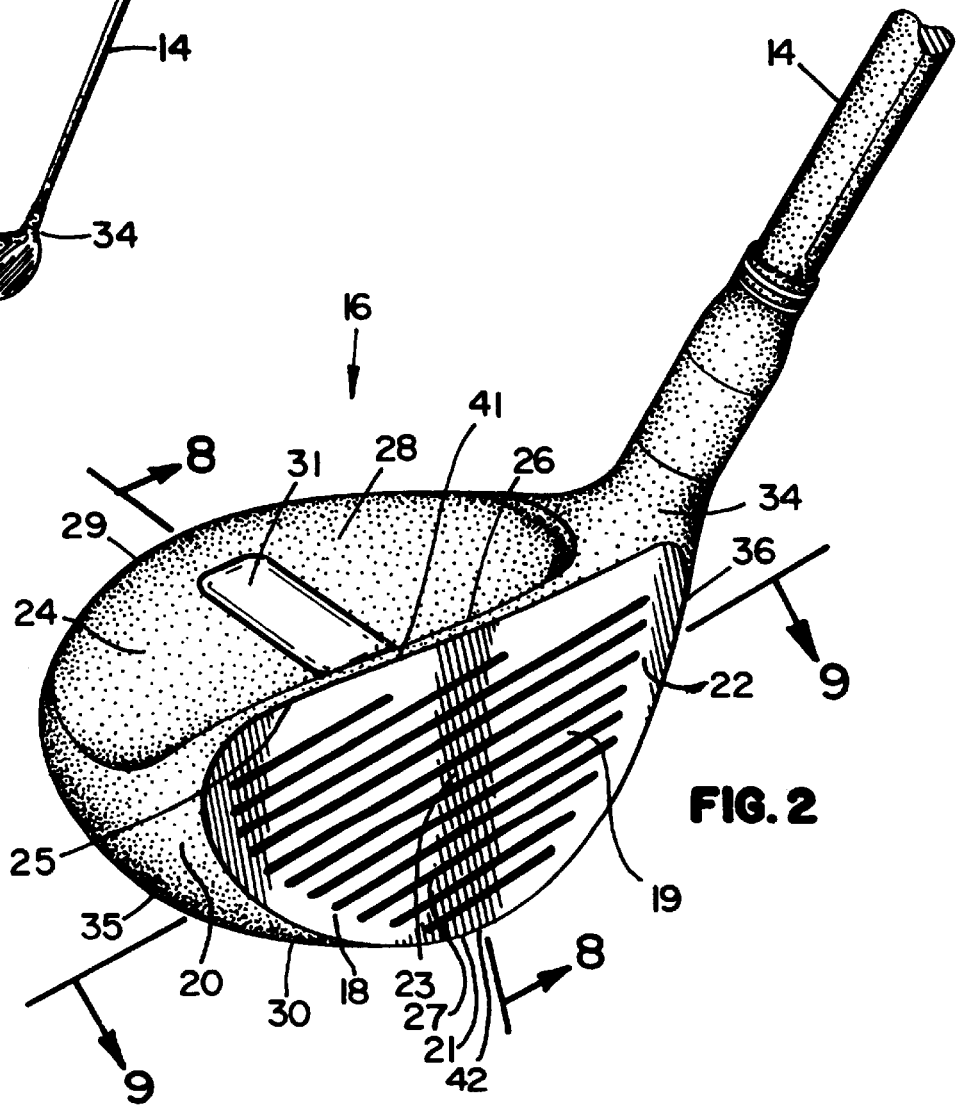
FIG. 2 is a perspective view of the club head of the golf club of FIG. 1.
Figure 3:
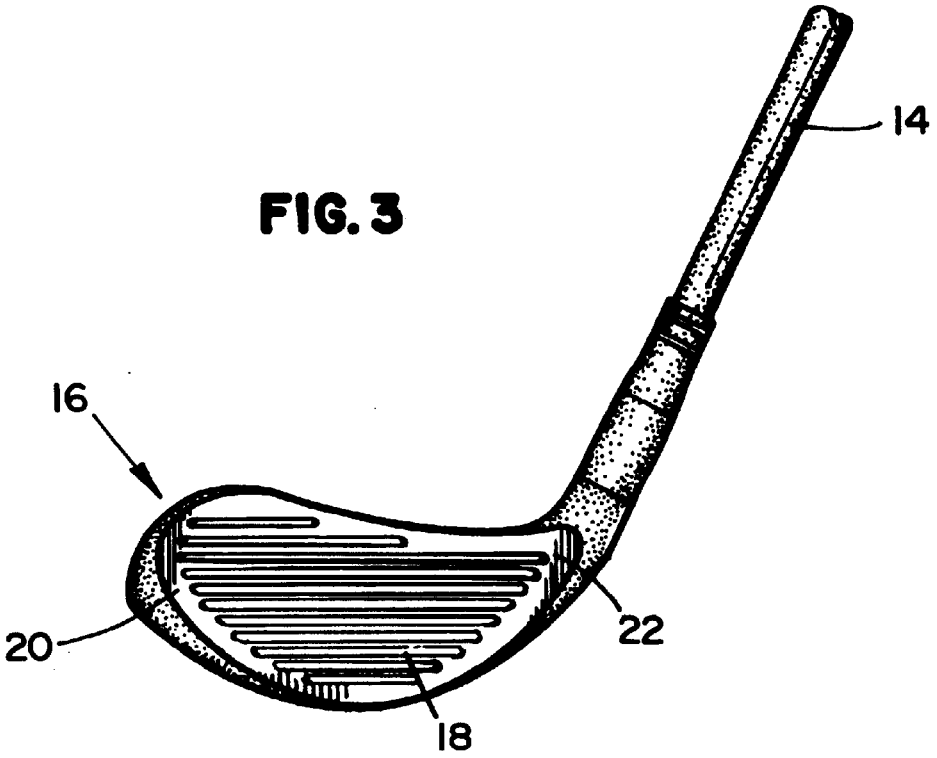
FIG. 3 is a front view of the golf club head of the golf club of FIG. 1.
Figure 4:
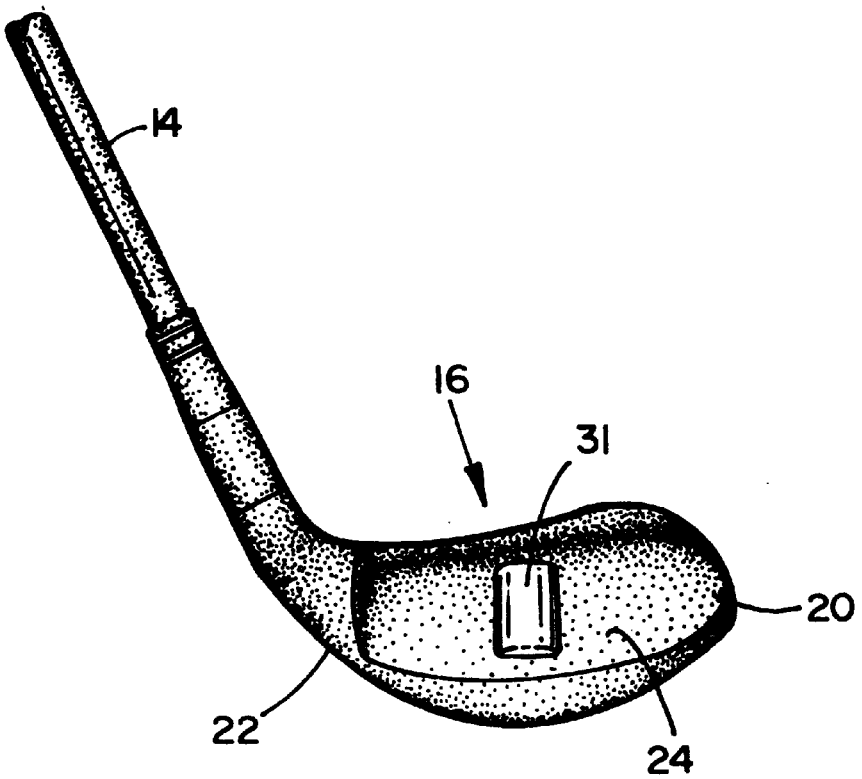
FIG. 4 is a rear view of the golf club head of the golf club of FIG. 1.

For purposes of the description herein, the terms, "front", "back", "top" and "bottom" refer to the orientation provided in FIG. 2, with the striking surface 18 representing the front of the club head 16. It should be understood that when the club is described as lying "at rest," it is meant that the club is in such a position so as to be held by the golfer before the golfer would strike a golf ball, with the club head resting on the ground and the striking surface 18 facing generally towards the intended target. It should be appreciated that the golf club 10 described herein is for a right-handed golfer, but the present invention relates to a golf club for both right-handed and left-handed golfers. Thus, the orientation of the golf club 10 described herein should be reversed for a left-handed golf club, with the face 18 of the club, for example, pointing backwards in relation to the orientation provide in FIG. 2.

Referring now to FIG. 2, the club head 16 includes a striking surface 18, a toe region 20, a heel region 22 and a mass region 24.

The striking surface 18 is that portion of the club head 16 which is adjacent to the golf ball when the club lies at rest. It is connected to a sole plate 30 at the bottom edge 21 of the striking surface 18 and the mass region 24. The height h of the striking surface 18 is preferably between about 1¼ inches and 2¾ inches, and more preferably between about 1¾ inches and 2 inches. What is meant by the height h of the striking surface 18 is the vertical distance between the midpoint 41 of the top edge of the striking surface 18 and the midpoint 42 of the bottom edge 21 of the striking surface 18. A lip 26 is formed by providing that the striking surface 18 extends above the top side 28 of the mass region 24.

The striking surface 18 includes a face 19, which is the portion of the striking surface 18 used to strike the golf ball. The face 19 is preferably substantially flat. By substantially flat, it is meant that the face 19 lacks a bulge and roll sufficient to cause a gear effect. The term "bulge" generally refers to convex curvature in a golf club face from the top of the striking surface to the bottom. The term "roll" generally refers to the convex curvature in a golf club face from toe to heel. Bulge and roll is known to cause a gear effect on golf shots. What is meant by the "gear effect" is the phenomenon of golf shots returning toward the intended target after being initially directed away from the intended target as a result of being hit off the toe or heel of the club. The gear effect is caused by spin imparted in a right to left fashion for shots unintentionally hit off the toe and in a left to right fashion for shots hit off the heel of the club head. Thus, whereas a shot hit off the toe of the club usually begins traveling at an angle to the right of the intended target, the right to left spin imparted on the ball by the gear effect causes the ball to gradually spin back towards the intended target. Similarly, whereas a shot hit off the heel of the club starts to the left of the intended target, the left to right spin imparted on the ball by the gear effect causes the ball to return gradually toward the intended target.

While the invention is described in the context of a preferred embodiment where the face 19 lacks a bulge and roll, it should be appreciated that alternative embodiments include a face which has a bulge and roll. That is, the invention includes a golf club head which has a face providing a bulge and roll sufficient to cause a gear effect on a golf ball.

A substantially flat face 19 is advantageous in order to reduce side spin on the golf ball. Many amateur golfers often have difficulty hitting a golf ball where they intend or desire to hit it because of the unwanted side spin they impart on the ball with their shots. The substantially flat face 19 of the golf club 10 described herein is desirable for these golfers, because it tends to reduce the side spin they impart on the ball, causing them to hit the ball straighter toward their intended target. Moreover, by reducing side spin, a substantially flat face 19 tends to increase underspin on the golf ball, causing the ball to fly higher and land softer, which also tends to increase accuracy of shots.

The lip 26 between the top edge 25 of the striking surface 18 and the mass region 24 is formed by extending the striking surface 18 above the top side 28 of the mass region 24. The height of the lip 26, being the vertical distance between the top edge 25 of the striking surface 18 and the top side 28 of the mass region 24, is preferably about ⅛ inch to about ½ inch. The lip 26 increases the surface area of the face 19, thereby increasing the sweet spot 23 of the face 19. The sweet spot 23 is that portion of the face 19 in which it is most desirable to make contact with the golf ball to hit the ball the desired distance and with the desired accuracy. The larger the sweet spot, the easier it is for the golfer to make solid contact with the golf ball.

The lip also provides more weight to the striking surface 18 near the heel region 22 and the toe region 20 than without the presence of lip 26, which increases the force behind those shots hit from those areas and thus increasing the margin for error for shots hit from those areas.

The face 19 preferably includes grooves 27. The grooves 27 can be provided in those shapes commonly used on faces of golf clubs. Shapes of exemplary grooves include horizontal lines extending across the face 19 and parallel to the ground. The grooves are desirable because they tend to adhere to a golf ball better than without, providing greater control over ball flight. It is advantageous to be able to control the flight of the ball to be more accurate in making golf shots.

Figure 8:
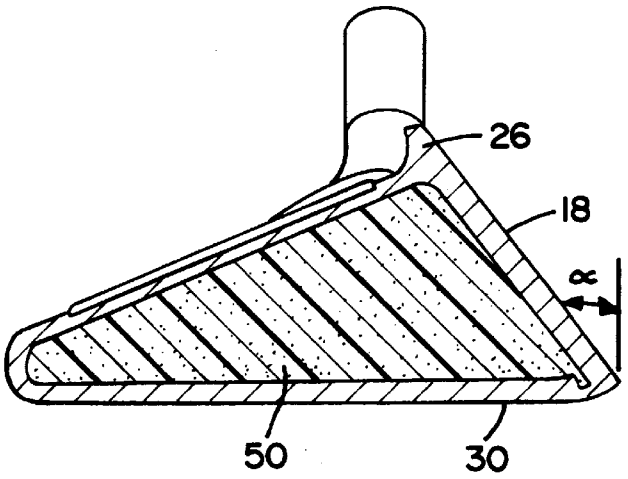
FIG. 8 is a sectional view of the golf club head of the golf club of FIG. 2 taken through lines 8—8.

The striking surface 18 is provided at a face angle $\alpha$, as depicted in FIG. 8. The face angle $\alpha$ refers to the angle formed by the striking surface 18 and the ground as the club head lies at rest. Face angle $\alpha$ may vary among clubs. Exemplary face angles include angles of 14 to 16, 21 to 23, 29 to 31 and 37 to 39 degrees. Typically, lesser face angles may be used with longer shafts, and vice-versa. This is desirable because shaft length directly corresponds to club head speed. That is, the same swing produces greater club head speed with a longer shaft. Greater club head speed results in a more forceful impact with the golf ball, thereby resulting in a longer golf shot. Similarly, the less face angle on a club face, the less the launch angle and the further the ball will be propelled. Thus, clubs designed to hit the ball longer generally contain both longer shafts and lesser club face angles than clubs designed to hit the ball shorter distances.

Figure 9:
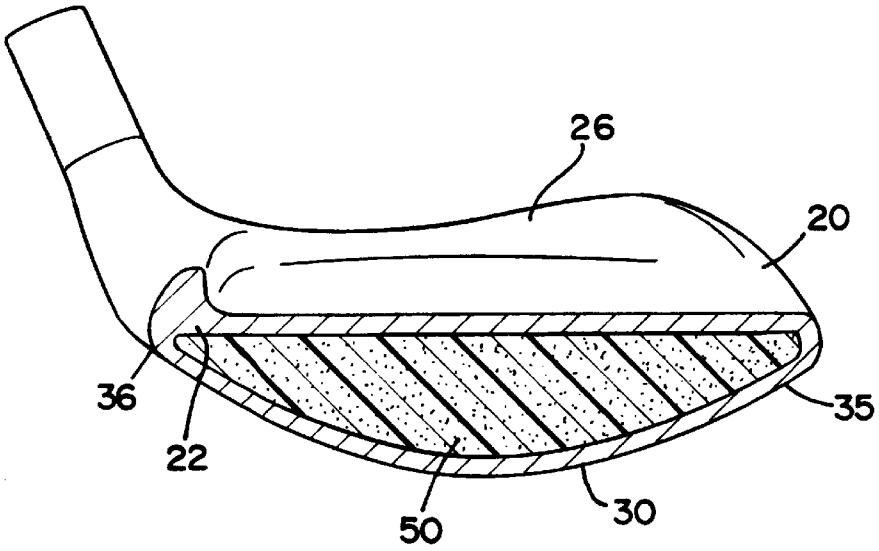
FIG. 9 is a sectional view of the golf club head of the golf club of FIG. 2 taken through lines 9—9.

The sole plate 30 generally forms the bottom surface of the club head 16. The sole plate 30 extends from the bottom edge 21 of the striking surface 18 across to the rear edge 29 of the mass region 24 and from the toe edge 35 to the heel edge 36. The sole plate 30 contains a sole 32. The sole 32 is the portion of the sole plate 30 which is designed to contact the ground as the club lies at rest. The curvature of the sole plate 30 generally reflects the circumference of a circle. As shown in FIG. 9, the curvature between the toe edge 35 and the heel edge 36 generally conforms to the circumference of a circle, although it is not perfectly circular. Preferably, the curvature has a radius of between about 2 inches and about 3¼ inches. By virtue of this curvature, the club head toe region 20 and the club head heel region 22 tend to sit above the ground when the club head 16 lies at rest.

Figure 5:
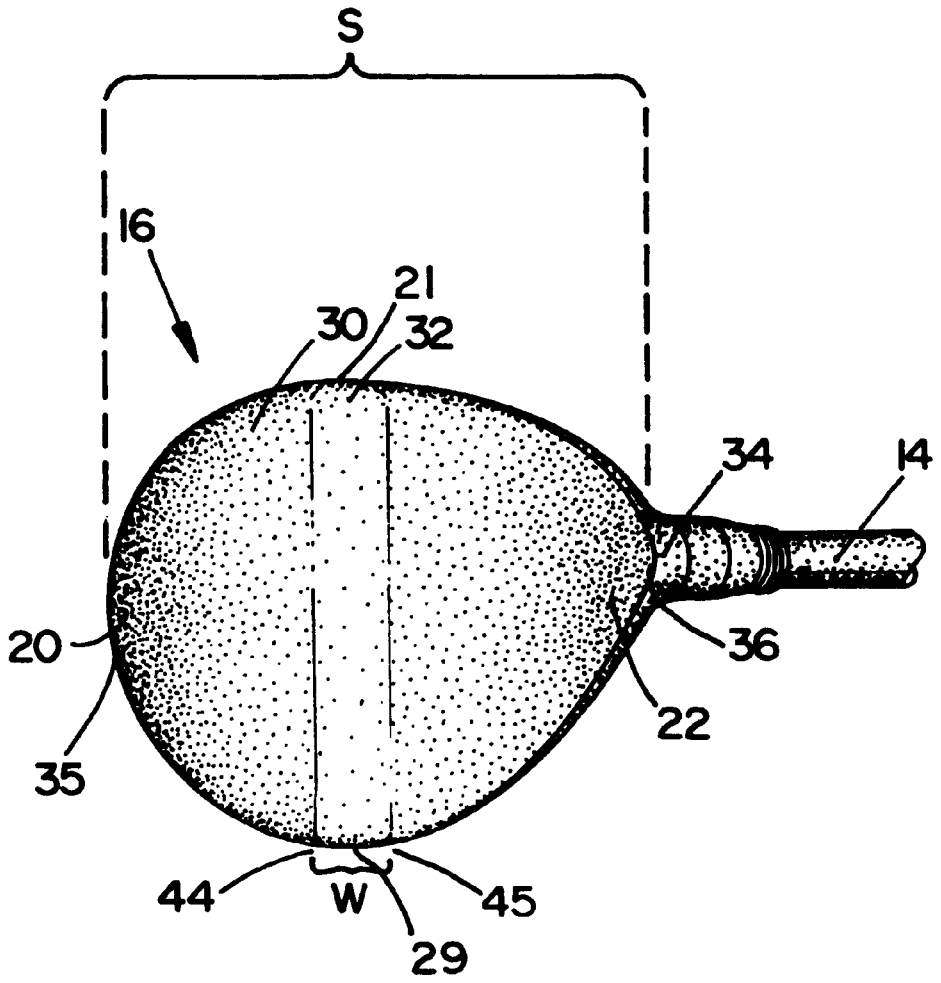
FIG. 5 is a bottom view of the golf club head of the golf club of FIG. 1.
Figure 6:
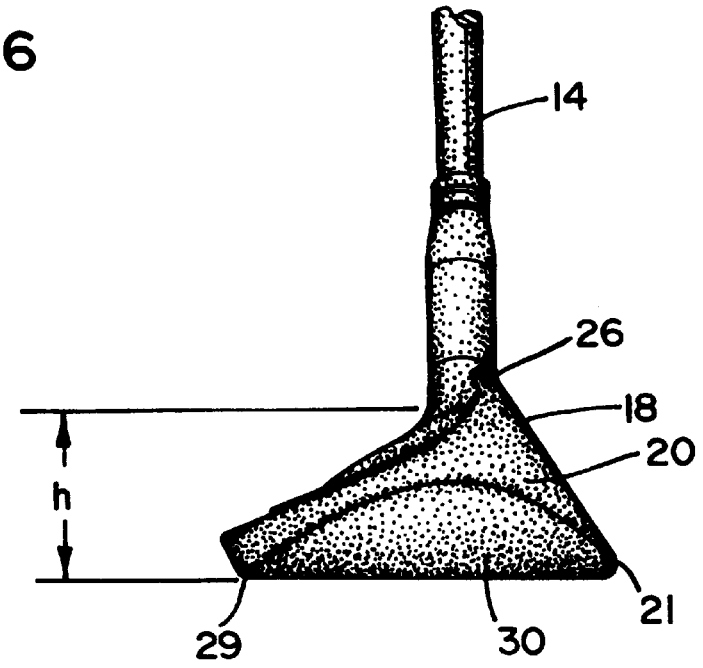
FIG. 6 is a toe end view of the golf club head of the golf club of FIG. 1.
Figure 7:
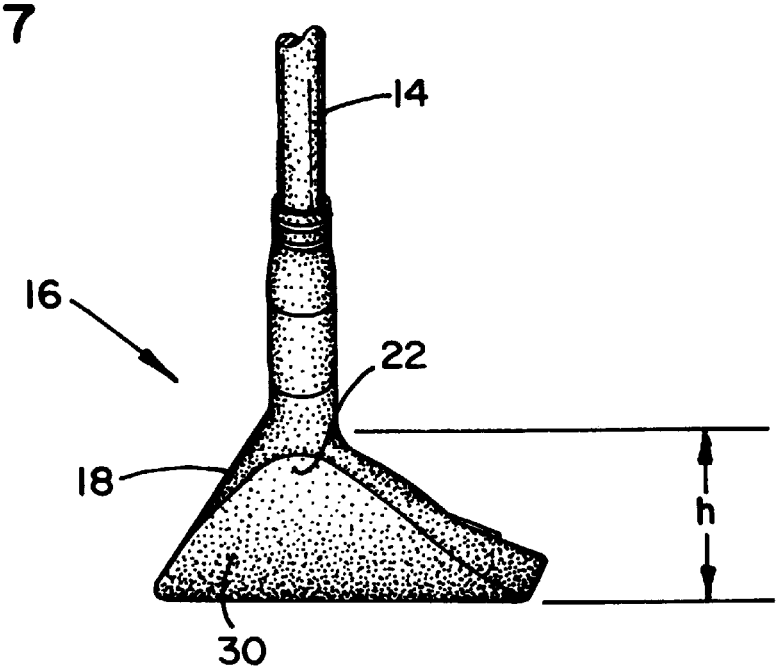
FIG. 7 is a heel end view of the golf club head of FIG. 1.

It is the sole 32 which is generally responsible for creating a divot during a golf swing. It is an advantage of the present invention that the width w of the sole 32, as depicted in FIG. 5, is relatively narrow. It is this narrow width w which provides a relatively narrow and long divot when the club 10 is swung properly. By providing a sole 32 with a narrow width w, it is easier for the club head 16 to swing through longer grass. Preferably, the width w of the sole 32 is between about ½ inch and about 1½ inches. More preferably, the width w of the sole 32 is between about ¾ inch and about 1¼ inches.

It is also advantageous that the sole 32 extends entirely from the bottom edge 21 of the striking surface 18 to the rear edge 29 of the mass region 24. This full extension allows the sole 32 more easily to cut through longer grass than clubs without a sole extending entirely from the front to the back of the sole plate.

The distance from the toe end 44 of the width w of the sole 32 to the edge 35 of the sole plate 30 is preferably between about 1 inch and about 2 inches. The distance from the heel end 45 of the width w of the sole 32 to the heel edge 36 of the sole plate 30 is preferably between about 1 inch and about 2½ inches. The ratio of the width s of the sole plate 30 to the width w of the sole is preferably between about 6:1 to about 3:1.

The mass region 24 is provided behind the club head striking surface 18. The mass region 24 is connected to the striking surface 18 at a lip 26 extending between the two adjacent to the top edge 25 of the striking surface 18. The top side 28 of the mass region 24 slopes downward linearly from the lip 26 to the rear edge 29 of the mass region 24.

The club 10 is provided with a low vertical center of gravity. What is meant by a "vertical center of gravity" is the center of gravity in relation to the distance between the top edge 25 of the striking surface 18 and the bottom edge 21 of the striking surface. The vertical center of gravity of the club head 16 is preferably located below the median distance between the top edge 25 of the striking surface 18 and the bottom edge 21 of the striking surface 18. The vertical center of gravity may also preferably be located below the equator of a golf ball when placed adjacent to the striking surface 18 on the ground or a planar surface.

Generally, the vertical center of gravity is dependent upon the location and distribution of weight in a club head. The low vertical center of gravity in the present invention is provided by its weight being located and distributed relatively low, close to the ground as the club head lies at rest. The relatively small height h of the mass region 24 contributes to the low vertical center of gravity. The linear downward slope of the top side 24 of the mass region from front to back also concentrates weight lower in the club head, contributing to the low vertical center of gravity. A substantial portion of the weight of the golf club head 16 is contained in the sole plate 30, further contributing to the low vertical center of gravity.

A low vertical center of gravity is desirable in that many golfers have difficulty getting the golf ball as air borne as they intend or desire. A club head with a low vertical center of gravity is advantageous for such a golfer by more easily allowing the golfer to make solid contact with the golf ball below the golf ball's equator. This in turn allows the golfer to hit the ball up in the air easier than with a club with a higher vertical center of gravity.

In addition, a club with a low vertical center is desirable generally for all golfers in certain situations. A club with a low vertical center of gravity is useful for hitting shots with a high trajectory, which in turn results in high, soft landing shots. Such shots are desirable over shots with lower trajectories for all golfers, for example, when a golfer desires to hit the golf ball over tall obstacles such as trees. Shots with high trajectories are also desirable when a golfer wishes to hit a shot with minimal roll after landing, such as on to a green.

The portion of the club head 16 which attaches the club head 16 to the shaft 14 is known as the hosel 34. The club 10 is provided with a horizontal center of gravity preferably located in line with the hosel 34. What is meant by the "horizontal center of gravity" is the center of gravity located at a distance between the bottom edge 21 of the striking surface 18 and the rear edge 29 of the mass region 24.

It is advantageous to have the horizontal center of gravity of the club head 16 in line with the hosel 34 in that it is relatively rearwardly located within the club head 16. This allows a golfer to hit the ball up in the air easier than with a horizontal center of gravity located further towards the front of the club head. The rearward horizontal center of gravity also increases the chance of making solid contact with the golf ball out of difficult lies, by allowing the club more easily to cut through the surface of the ground, such as deep rough and fairway bunker sand.

The size and static weight of the club head 16 may vary, according to the use or purpose of the club. Generally, the club head 16 used to hit the ball lower and farther distances will be smaller and lighter than one used to hit the ball higher and shorter distances. Thus, the size and static weight will increase for clubs with lesser face angles and longer shafts 14 than those with higher face angles and shorter shafts 14. Exemplary sizes include 60 to 130 cubic centimeters. Exemplary static weights for different clubs include 221 to 229, 238 to 246, 252 to 260 and 268 to 276 grams.

The thickness of the walls of the club head 16 may vary. Generally, they should be of such a thickness to ensure that the club head 16 is sufficiently strong to repeatedly strike a golf ball at high swing speeds. At the same time, they should not be so thick so as to add unnecessary weight to the club head 16. The thickness of the walls of the club head 16 may also vary according to the material used to manufacture the club head 16.

The golf club 10 club may be made of materials commonly used for manufacturing golf clubs. Exemplary materials for the handle include 12 leather and rubber. Exemplary materials for the shaft 14 include steel and graphite. Exemplary materials for the club head 16 include stainless steel, titanium and a steel alloy. The face 19 may include materials different than the remainder of the club head 16. Exemplary materials of the face 19 include stainless steel and titanium. Titanium may be used, for example, for a face 19 of a club head 16 that is otherwise comprised of stainless steel, because titanium is lighter and stronger than stainless steel. It is desirable to have a light material making up the club head, and the golf club generally, because the lighter the club or club head, the faster a golfer can swing the club, thus generating greater club head speed. The greater the club head speed, the greater is the force of impact of the golf ball. A golf ball is propelled in direct relation to the force of impact, and thus, the greater the club head speed a golfer can generate, the further the ball will go.

The inside of the club head 16, inside the walls of the striking surface 18, the sole plate 30 and the top side 28 of the mass region 24, may be filled with a material, an exemplary material of which is foam 50. Alternatively, the inside of the club head 16 may be hollow. A foam-filled center 50 may be preferable in that it may tend to reduce noise and to reduce the vibration upon impact with the golf ball.

The sole plate 30 may contain markings to indicate name of the club, its uses or other information.

The top side 28 of the mass region 24 may contain an emblem or other markings 31, situated perpendicularly to the club head face 18. The emblem or markings 31 may be provided directly in line with the sweet spot 23 of the face 19, to assist the golfer in aligning the club 10 before a shot.

I claim:

1. A golf club, comprising:

a club head comprising a striking surface, a toe region, a heel region, a sole plate, a mass region, and a hosel;

said striking surface comprising a face for striking a golf ball, wherein said striking surface extends above a top side of said mass region to form a lip extending between the striking surface and the top side of the mass region;

said sole plate extending from a bottom edge of the striking surface to a rear edge of said mass region and under said toe region and said heel region, and comprising a sole resting on ground as the club head lies at rest, and having a width between about ½ inch and about 1½ inches;

said club head including a vertical center of gravity below a median between the top edge of the striking surface and the bottom edge of the striking surface; and a shaft attached to said club head by the hosel of the club head.

2. A golf club according to claim 1, wherein the height of said lip, which is the vertical distance between the top edge of said striking surface and the top side of said mass region, is between about ⅛ inch and about ½ inch.

3. A golf club according to claim 1, wherein the vertical distance between the midpoint of the top edge of the striking surface and the midpoint of the bottom edge of the striking surface is between about 1¼ inches and about 2¾ inches.

4. A golf club according to claim 1, wherein the vertical center of gravity of the club head is located below the equator of a golf ball when the club head and the golf ball are resting on a planar surface.

5. A golf club, comprising:

a club head comprising a striking surface, a toe region, a heel region, a sole plate, a mass region, and a hosel;

said striking surface comprising a face for striking a golf ball;

said sole plate extending from a bottom edge of the striking surface to a rear edge of said mass region and under said toe region and said heel region, and comprising a sole resting on ground as the club head lies at rest, and having a width between about ½ inch and about 1½ inches, said sole plate extending from a toe edge to a heel edge and the ratio of the width of the sole plate to the width of the sole is between about 6:1 and about 3:1;

said club head including a vertical center of gravity below a median between the top edge of the striking surface and the bottom edge of the striking surface; and a shaft attached to said club head by the hosel of the club head.

6. A golf club according to claim 5, wherein the vertical distance between the midpoint of the top edge of the striking surface and the midpoint of the bottom edge of the striking surface is between about 1¼ inches and about 2¾ inches.

7. A golf club according to claim 5, wherein the curvature of the sole plate generally conforms to the circumference of a circle having a radius of between about 2 inches and about 3¼ inches.

8. A golf club according to claim 5, wherein the vertical center of gravity of the club head is located below the equator of a golf ball when the club head and the golf ball are resting on a planar surface.

9. A golf club according to claim 5, wherein the club head further comprises a horizontal center of gravity between the bottom edge of the striking surface and the rear edge of the top side of the mass region, located generally in line with the hosel.

10. A golf club, comprising:

a club head comprising a striking surface, a toe region, a heel region, a sole plate, a mass region, and a hosel;

said striking surface comprising a face for striking a golf ball;

said sole plate extending from a bottom edge of the striking surface to a rear edge of said mass region and under said toe region and said heel region, and comprising a sole resting on ground as the club head lies at rest, and having a width between about ½ inch and about 1½ inches, the curvature of the sole plate generally conforms to the circumference of a circle having a radius of between about 2 inches and about 3¼ inches;

said club head including a vertical center of gravity below a median between the top edge of the striking surface and the bottom edge of the striking surface; and a shaft attached to said club head by the hosel of the club head.

11. A golf club according to claim 10 wherein the vertical distance between the midpoint of the top edge of the striking surface and the midpoint of the bottom edge of the striking surface is between about 1¼ inches and about 2¾ inches.

12. A golf club according to claim 10, wherein said sole plate extends from a toe edge to a heel edge and the ratio of the width of the sole plate to the width of the sole is between about 6:1 to about 3:1.

13. A golf club according to claim 10, wherein the vertical center of gravity of the club head is located below the equator of a golf ball when the club head and the golf ball are resting on a planar surface.

14. A golf club according to claim 10, wherein the club head further comprises a horizontal center of gravity between the bottom edge of the striking surface and the rear edge of the top side of the mass region, located generally in line with the hosel.

15. A golf club, comprising:

a club head comprising a striking surface, a toe region, a heel region, a sole plate, a mass region, and a hosel;

said striking surface comprising a face for striking a golf ball;

said sole plate extending from a bottom edge of the striking surface to a rear edge of said mass region and under said toe region and said heel region, and comprising a sole resting on ground as the club head lies at rest, and having a width between about ½ inch and about 1½ inches;

said club head including a vertical center of gravity below a median between the top edge of the striking surface and the bottom edge of the striking surface and a horizontal center of gravity between the bottom edge of the striking surface and the rear edge of the top side of the mass region, located generally in line with the hosel; and a shaft attached to said club head by the hosel of the club head.

16. A golf club according to claim 15, wherein the vertical distance between the midpoint of the top edge of the striking surface and the midpoint of the bottom edge of the striking surface is about 1¼ inches and about 2¾ inches.

17. A golf club according to claim 15, wherein said sole plate extends from a toe edge to a heel edge and the ratio of the width of the sole plate to the width of the sole is between about 6:1 to about 3:1.

18. A golf club according to claim 15, wherein the curvature of the sole plate generally conforms to the circumference of a circle having a radius of between about 2 inches and about 3¼ inches.

* * * * *